United States Patent [19]

Heard

[11] 4,341,029

[45] Jul. 27, 1982

[54] MOUNTING FOR OFFSET SIGNS

[76] Inventor: Robert A. H. Heard, Church Farm, 63 Church La., Backwell, Bristol, BS19, 3JJ, England

[21] Appl. No.: 226,130

[22] Filed: Jan. 19, 1981

Related U.S. Application Data

[63] Continuation of Ser. No. 35,913, May 4, 1979, abandoned.

[51] Int. Cl.[3] ..... G09F 15/00

[52] U.S. Cl. ..... 40/607; 40/10 R; 40/617; 248/231

[58] Field of Search ..... 40/607, 606, 10, 21, 40/617; 248/231

[56] References Cited

U.S. PATENT DOCUMENTS

| | | | |
|---|---|---|---|
| 3,894,707 | 7/1975 | Heard | 40/607 |
| 4,209,928 | 7/1980 | Kraayvanger | 40/607 |
| 4,217,716 | 8/1980 | Acquaviva | 40/607 |

OTHER PUBLICATIONS

Publication "SIGNFIX" of Signfix of North America, Inc.

*Primary Examiner*—Gene Mancene
*Assistant Examiner*—Wenceslao J. Contreras
*Attorney, Agent, or Firm*—William R. Hinds

[57] ABSTRACT

A mounting for an offset sign comprises a channel shaped saddle (10), the sides (16) of which are adapted (18) to seat against a supporting post. Attachment elements (12) are located at opposite ends of the saddle and are adapted (32) to take a strap for passing around the post. They are joined by a connecting plate (22) which is urged towards the base (14) of the saddle when the strap is tightened. A mounting plate (28) projects from the connecting plate (22) and has a flange (30) located between the connecting plate and the base (14) of the-saddle. The mounting plate (28) is apertured (36) for attachment to the top of an elongate T-shaped member the leg of which is secured to an edge portion of the sign plate.

10 Claims, 9 Drawing Figures

-14-
-40-
A

MOUNTING FOR OFFSET SIGNS

This is a continuation, of application Ser. No. 35,913 filed May 4, 1979 now abandoned.

FIELD OF THE INVENTION

This invention relates to sign mountings, and more particularly is directed to means for mounting an offset sign to a supporting post.

BACKGROUND TO THE INVENTION

Mounting a sign plate generally radially to a post creates problems different from those where the post is secured to the rear of the sign. In the latter case, the post can be mounted in the middle of the sign, or two or more posts can be used if necessary, and channel or other reinforcing members can be secured to the rear of the sign plate. With offset signs, however, the post has to be secured to one side edge of the sign, thereby requiring a special type of mounting device. Usually only one post can be used, so that the mounting has to support the full cantilever weight of the sign. Also the sign usually has indicia on both surfaces so that any reinforcing members have to be restricted to the top and bottom edges without obscuring the sign surface. Finally, the whole arrangement should be as neat as possible so as to be visually acceptable, while keeping the cost of the sign within acceptable limits. Associated with this is the desirability of having a mounting device which can be used with a variety of different size signs and posts.

SUMMARY OF THE INVENTION

According to the present invention there is provided a device for mounting an offset sign plate to a supporting post, comprising a transverse element, a pair of attachment elements at opposite ends thereof adapted for connection to a portion of a said post received between the attachment elements, and a mounting plate projecting from the transverse element at right angles thereto in a plane normal to the longitudinal axis of said post.

The mounting device preferably includes a channel shaped saddle member comprising a pair of opposite side elements of similar form and spaced apart and joined by said transverse element, the side elements being adapted along their edges remote from said transverse element to seat against a said post, the attachment elements being disposed at opposite ends of the saddle. Preferably the attachment elements are formed separately from the saddle and are joined by a connecting element which extends parallel to said transverse element and is urged towards it when the attachment elements are secured to a said post. The mounting plate preferably has a limb at right-angles thereto which is located between the transverse element and the connecting element. The mounting plate may be provided with apertures for securing it to one face of an elongate angle member which is to carry the sign plate.

BRIEF DESCRIPTION OF THE DRAWINGS AND DESCRIPTION OF EXEMPLIFIED EMBODIMENTS

In order that the invention may be more clearly understood, various embodiments will now be described with reference to the accompanying drawings, wherein.

Figures 1, 2, 3:
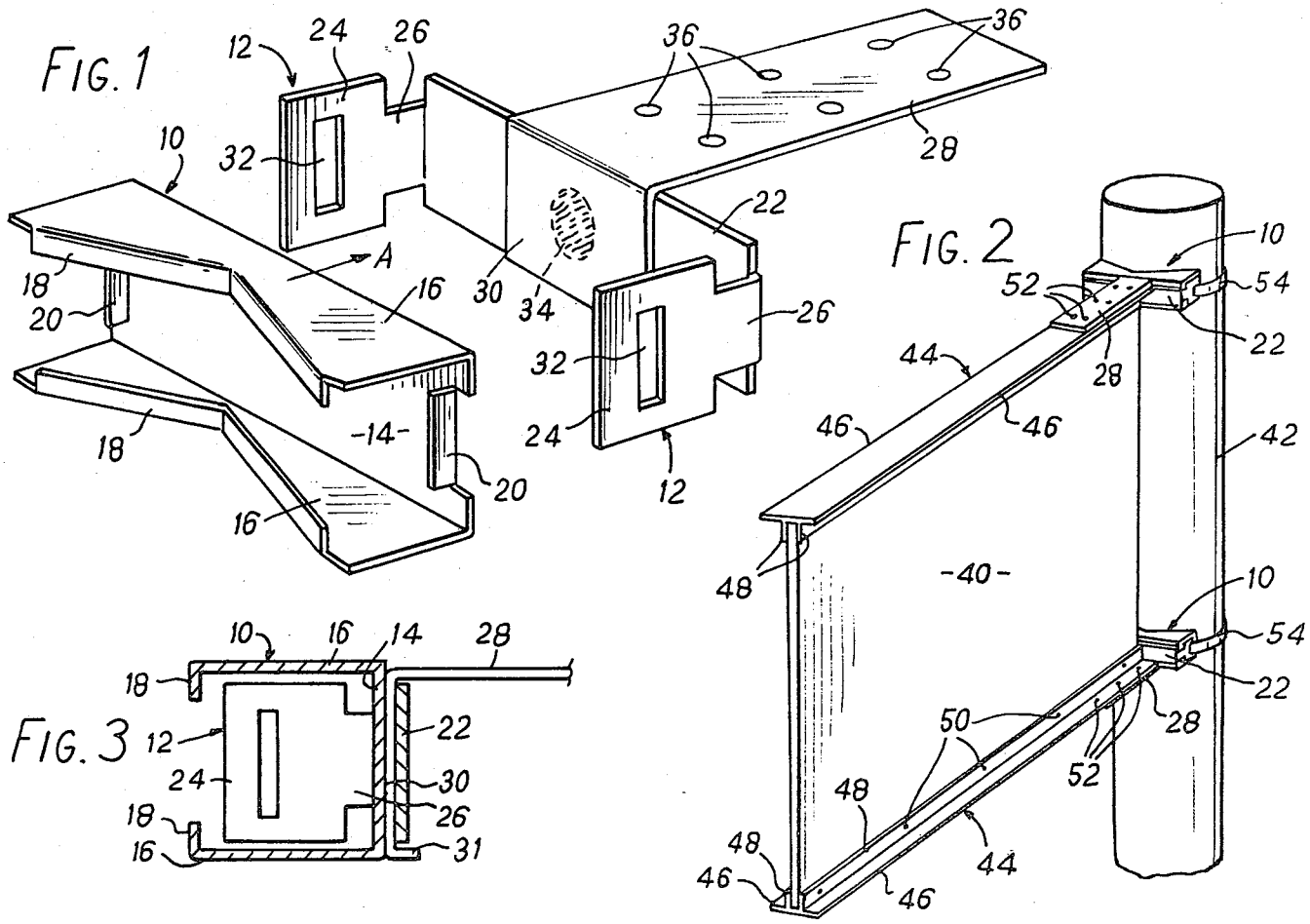
FIG. 1 shows an exploded view of a first embodiment of mounting bracket.
FIG. 2 shows a perspective view of an offset sign mounted to a post using a pair of brackets of FIG. 1.
FIG. 3 shows a cross-section through the bracket incorporating a small modification.

Referring to the drawings, and firstly to FIG. 1; the bracket comprises a saddle 10 and a pair of attachment elements 12. The saddle is made from a single piece of sheet metal, for example stainless steel sheet, and comprises a flat transverse element 14 and a pair of side elements 16 projecting therefrom. The side elements are of similar shape, their edges remote from the transverse element 14 being of shallow V-shape and are turned over to provide mutually inwardly directed flanges 18. A part of the transverse element at each end thereof is turned upwardly between the side elements to provide flanges 20. The attachment elements 12 are likewise conveniently made from sheet metal. Each comprises a rectangular body part 24 which is slightly narrower than the spacing between the side elements 16 of the saddle. A narrower stem 26 projects from the body 24, and the two necks are joined on the side of the transverse element remote from the bodies by an elongate connecting plate 22. Each body 24 has a slot 32 therein to receive a flexible high tensile strap for securing the bracket to the post, as described later with reference to FIG. 2. An elongate mounting plate 28, conveniently of stainless steel sheet, is bent at right angles at one end to provide a flange 30 which is spot-welded at 34 to the surface of the connecting plate nearest the bodies 24. Thus, the mounting plate extends away from the bodies of the attachment elements in a plane at right angles to the plane of the connecting element. The mounting plate is provided with two rows of apertures 36, to be used as described below. The attachment elements and connecting plate are loosely connected to the saddle by slightly spreading the bodies of the attachment elements and introducing the saddle between them in the direction indicated by the arrow A in FIG. 1. On releasing the attachment elements, the bodies locate loosely between the sides of the saddle, and the stems of the attachment elements locate freely within the recesses in the transverse element 14 provided by the flanges 20.

In use, a sign plate 40 is to be attached in an offset manner to a supporting post 42. To the top and bottom edges of the sign plate are attached a pair of extrusions 44 suitably of aluminium, and of generally T-shape cross-section. More specifically, the cross-section provides a pair of first flanges 46 extending in a common plane in opposite directions from a pair of second flanges 48 which are parallel to each other and form the leg of the T. The pair of second flanges between them define a slot of width slightly greater than the thickness of the sign plate. The extrusions 44 are secured along the upper and lower edges of the sign plate 40 by receiving the edge portions of the sign plate in the slots defined by the flanges 48. Holes are then drilled at intervals through the flanges 48 and the enclosed edge portions of the sign plate to receive rivets 50 which secure the extrusions 46 to the sign plate. A pair of brackets of FIG. 1 are mounted to the extrusions 44 by bringing the flanges 46 face to face with the mounting plates 28 of the brackets, drilling holes through the flanges 46 corresponding to the holes in the mounting plates, and then riveting them together as indicated at 52. A stainless steel strap 54 is threaded through the slots 32 in the attachment elements of each bracket, passed around the post 42 and tightened and secured with a buckle in conventional manner, the V-shaped edges of the saddles seating against the post. This is described in more detail in my United Kingdom Patent Specification No. 1533412. In this way, the sign plate is secured to the post so as to project radially therefrom.

FIG. 3 shows a variation in which the flange 30 of the mounting plate is provided with a return lip 31 at its free edge. By this means the mounting plate need not be permanently fixed to the connecting plate 22, since in use the connecting plate will be drawn tightly towards the transverse element of the saddle by the tightening of the strap and this will clamp the flange 30 between the connecting plate and the transverse element of the saddle, the lip 31 preventing the escape of the flange 30. Thus, existing saddle mounting devices (as in FIG. 1 but without the support plate) could be readily used in the manner of the present invention by providing a separate support plate as in FIG. 3.

Figure 4:
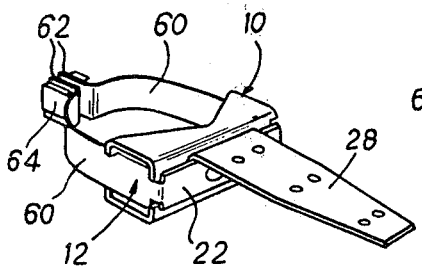
FIGS. 4 to 9 show perspective views of various alternative or modified embodiments.

FIG. 4 shows a modification of the foregoing mounting bracket in which the attachment elements 12, instead of being slotted to receive a strap, are provided with integral extensions 60 which form straps for passing around the mounting post. At their free ends the straps 60 are provided with out-turned flanges 62 which are apertured to take a nut and bolt 64 by means of which they are tightened around the post.

Figure 5:
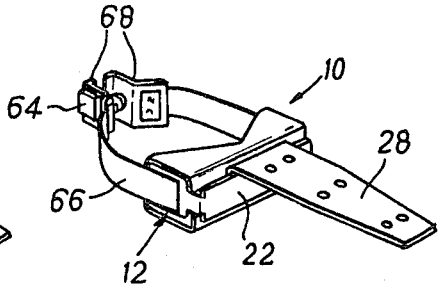

FIG. 5 shows a bracket of the general type shown in FIGS. 1 to 3, but instead of using a flexible strap 54 of indefinite length and securing it by a buckle, a fixed length strap 66 is passed through the slotted bodies of the attachment elements 12, and the free ends of the straps are inserted into slots in a pair of end plates 68 and are welded to the end plates, the end plates having matching apertures through which they are adjustably interconnected by a nut and bolt 64. As a further modification of this arrangement, instead of a single fixed length strap 66 passed through the slots of both attachment elements, two separate strap lengths may be provided, their ends remote from the plates 68 being cranked and inserted into the slots in the attachment elements and welded thereto. The appearance of the mounting bracket is in either case as shown in FIG. 5.

Figure 6:
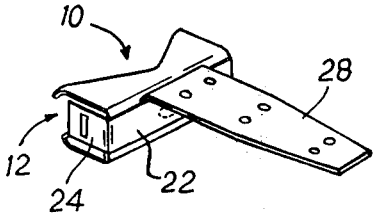

FIG. 6 shows a mounting bracket essentially similar to that of FIGS. 1 to 3, but slightly simplified in that flanges 20 are not provided in the transverse element 14, and the bodies 24 of the attachment elements 12 join the connecting plate 22 directly without any intermediate narrow neck.

Figure 7:
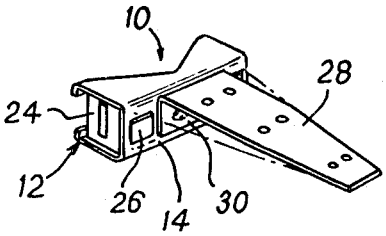

In the embodiment of FIG. 7, the stems 26 of the attachment elements 12 pass through slots in the transverse element 14 of the saddle member 10, and are bent at right angles to the bodies 24 of the attachment elements, and are preferably welded to the transverse element 14 of the saddle. In consequence, the attachment elements are connected by the transverse element of the saddle and not by a separate connecting plate, and the mounting plate 28 is therefore welded to the saddle, for example by its flange 30. As a modification of this arrangement, as indicated in dot-dash lines, the mounting plate 28, or at any rate its flange 30, may be sufficiently wide so that the stems 26 overlap the flange 30 (with the flange 30 sandwiched between the stems 26 and the transverse element 14 of the saddle), and can be welded thereto, thereby holding together the assembly.

Figure 8:
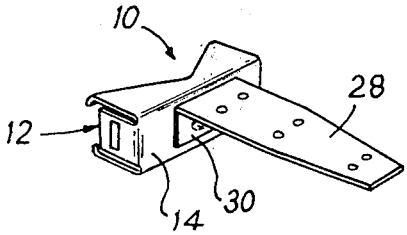

In a yet simpler embodiment shown in FIG. 8, the attachment elements 12 are formed integrally with the saddle from the same metal sheet, as an extension of the transverse element 14. In this arrangement, of course, the mounting plate 28 is secured direct to the saddle, for example by welding through its flange 30 as shown.

Figure 9:
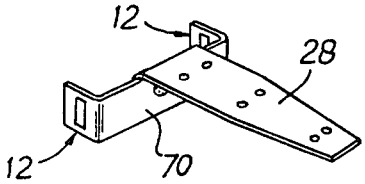

In an even simpler form of bracket, as shown in FIG. 9, the mounting elements 12 are connected by a transverse plate 70, from one edge of which projects the mounting plate 28. In effect this is similar to the embodiment of FIG. 6 but without the saddle 10. The mounting plate 28 can be formed separately from the transverse plate 70 and secured thereto, or it can be integrally formed therewith from the same metal sheet. This embodiment is used in the same way as the previous embodiments, except that, since there is no saddle, the post is engaged by the free edges of the attachment elements, or the central portion of the transverse plate 70 (through the strap if a single strap is used), or both.

In all of the foregoing embodiments, the mounting plate 28 may be relatively narrow as shown, or it may be widened (see FIG. 7 for example), particularly towards its inner end where it joins the rest of the bracket, especially for bigger and heavier signs. Furthermore, any of the foregoing embodiments may use slotted attachment elements with straps or strap lengths as described, or may have the attachment elements extended to form integral straps with means for adjustably interconnecting their free ends.

I claim:

1. A device for mounting a radially offset sign plate to a supporting post, comprising a channel shaped saddle member formed from sheet metal and having a pair of opposite side elements of similar form and spaced apart joined by a base element and adapted along their edges remote from the base element to seat against a supporting post, a pair of sheet metal attachment elements separate from the saddle and at opposite ends of the saddle member adapted for connection to a portion of a supporting post seated against the saddle member, a transverse elongate plate-like element of sheet metal joining the attachment elements and lying adjacent to the base of the channel of the saddle member on the side thereof remote from said edges of the side elements thereof, whereby the transverse element is urged toward the base of the saddle member when the attachment elements are secured to a supporting post, and a sheet metal mounting plate of L-form providing two limbs, a first shorter limb disposed between the transverse element and the base of the saddle member so as to be clamped between them when the transverse element is urged toward the base of the saddle member, and a second longer limb extending in the direction opposite to the channel mouth in a plane at right angles to that of the transverse element and the base of the saddle member and parallel to the length of the channel, the longer limb being apertured to receive means for securing thereto a flange at a radially extending edge of the sign plate.

2. A mounting device according to claim 1, wherein said first limb of the mounting plate is fast with the transverse element.

3. A mounting device according to claim 1 wherein said first limb of the mounting plate is attached neither to the transverse element nor to the base of the saddle member, but is held thereto by said first limb being clamped between the transverse element and the base of the saddle member when the attachment elements are secured to a said post.

4. A mounting device according to claim 3 wherein the free edge of said first limb is provided with a lip which abuts an edge of the transverse element or saddle to locate and retain the first limb between them.

5. A sign comprising a sign plate mounted generally radially to a supporting post by a pair of mounting devices according to claim 1, the sign plate having horizontal flanges along its top and bottom edges to which the mounting plates of the mounting devices are secured face-to-face.

6. A sign according to claim 5 wherein said flanges are provided by elongate generally T-sectioned members, the arms of the T providing the flange and the leg of the T being secured to the plate.

7. A mounting device as claimed in claim 1 wherein at least the part of said first shorter limb lying between the transverse element and the base of the saddle member comprises a planar, single-thickness section of sheet steel.

8. A mounting device as claimed in claim 7 wherein said second longer limb comprises a planar, single-thickness section of sheet steel bent at an angle substantially normal to said part of said first shorter limb.

9. A device for mounting a radially offset sign plate to a supporting post, comprising a pair of spaced apart attachment elements formed from sheet metal and adapted for connection to a portion of a supporting post received between them, a transverse elongate plate-like element of sheet metal joining the attachment elements, the attachment elements extending from opposite ends of the transverse element in the same direction out of the plane thereof, and a sheet metal mounting plate of L-form providing two substantially planar limbs, a first shorter limb disposed face-to-face with the transverse element on the same side as and midway between the attachment elements and fast with the transverse element, and a second longer limb bent out of the plane of the first limb and extending in the direction remote from the attachment elements in a plane at right angles to that of the transverse element and apertured to receive means for securing thereto a flange at an edge of the sign plate.

10. A device for mounting an offset sign plate to a supporting post, comprising a channel shaped saddle member formed from sheet metal and having a pair of opposite side elements of similar form and spaced apart joined by a base element and adapted along their edges remote from the base element to seat against a supporting post, a pair of sheet metal attachment elements fast with the saddle at opposite ends thereof adapted for connection to a portion of a supporting post seated against the saddle member, and a sheet metal mounting plate of L-form providing two limbs, a first shorter, substantially planar limb disposed face-to-face with the base element of the saddle member and secured thereto, and a second longer, substantially planar limb bent out of the plane of the first limb and extending in the direction opposite to the channel mouth in a plane at right angles to that of the first limb and parallel to the length of the channel, the longer limb being apertured to receive means for securing thereto a flange at a radially extending edge of the sign plate.

* * * * *